US008941385B2

(12) United States Patent
Patti et al.

(10) Patent No.: US 8,941,385 B2
(45) Date of Patent: Jan. 27, 2015

(54) ENHANCED METHOD OF SENSING IONIZATION CURRENT IN SPARK IGNITION INTERNAL COMBUSTION ENGINES AND RELATED SPARK PLUG STRUCTURES

(71) Applicant: STMicroelectronics S.r.l., Agrate Brianza (IT)

(72) Inventors: Davide Giuseppe Patti, Mascalucia (IT); Mario Paparo, San Giovanni la Punta (IT); Domenico Rossi, Cilavegna (IT)

(73) Assignee: STMicroelectronics S.R.L., Agrate Brianza (MB) (IT)

( * ) Notice: Subject to any disclaimer, the term of this patent is extended or adjusted under 35 U.S.C. 154(b) by 184 days.

(21) Appl. No.: 13/654,891

(22) Filed: Oct. 18, 2012

(65) Prior Publication Data

US 2013/0099792 A1 Apr. 25, 2013

(30) Foreign Application Priority Data

Oct. 19, 2011 (IT) ..... MI2011A1896

(51) Int. Cl.

| | |
|---|---|
| ***H01T 21/02*** | (2006.01) |
| ***H01T 13/30*** | (2006.01) |
| ***F02P 17/12*** | (2006.01) |
| ***H01T 13/40*** | (2006.01) |
| ***H01T 13/60*** | (2011.01) |

(52) U.S. Cl.

CPC ..... *H01T 13/40* (2013.01); *H01T 21/02* (2013.01); *H01T 13/60* (2013.01); *F02P 2017/125* (2013.01)

USPC ..... 324/339; 445/7; 313/141

(58) Field of Classification Search

CPC ..... H01T 13/40; H01T 13/60; H01T 21/02; H01T 13/39–13/41; F02P 2017/125–2017/123

See application file for complete search history.

(56) References Cited

U.S. PATENT DOCUMENTS

| | | | | |
|---|---|---|---|---|
| 4,476,412 | A | 10/1984 | Nishida et al. | |
| 5,237,280 | A | 8/1993 | Arnold et al. | |
| 5,734,094 | A | 3/1998 | Matsubara et al. | |
| 8,044,561 | B2 * | 10/2011 | Walker et al. | 313/141 |
| 8,471,450 | B2 * | 6/2013 | Walker et al. | 313/141 |
| 2012/0013240 | A1 * | 1/2012 | Walker et al. | 313/141 |
| 2014/0077683 | A1 * | 3/2014 | Walker, Jr. | 313/141 |

FOREIGN PATENT DOCUMENTS

FR 2 894 724 A1 6/2007

* cited by examiner

*Primary Examiner* — Jermele M Hollington

(74) *Attorney, Agent, or Firm* — Allen, Dyer, Doppelt, Milbrath & Gilchrist, P.A.

(57) ABSTRACT

A spark plug, including an insulator embedding a first metallic electrode axially extending therethrough from a high voltage outer end terminal to the center of the inner end of the insulator from which it protrudes; a metallic ground electrode isolated from the first electrode and having an extended inner termination facing toward the first electrode extending from the insulator tip for defining therebetween a spark gap, a resistive element connected to the ground electrode such that upon mounting the spark plug in an internal combustion engine, the ground electrode electrically connects to the engine body through the resistive element; and a second outer termination of the ground electrode, adapted to constitute an accessible sensing terminal.

13 Claims, 7 Drawing Sheets

ENHANCED METHOD OF SENSING IONIZATION CURRENT IN SPARK IGNITION INTERNAL COMBUSTION ENGINES AND RELATED SPARK PLUG STRUCTURES

CROSS REFERENCE TO RELATED APPLICATIONS

This application claims the priority benefit of Italian patent application number MI2011A001896, filed on Oct. 19, 2011, which is hereby incorporated by reference to the maximum extent allowable by law.

BACKGROUND

1. Technical Field

The present disclosure relates to detection of ionization current in spark plugs of internal combustion engines and more particularly to a method of sensing ionization current and to a spark plug structure allowing an extended sensing during the different phases of an engine cycle.

2. Discussion of the Related Art

In internal-combustion engines, the fuel-air gaseous mixture ignition is activated by a HV electric discharge across the spark plug electrodes. During combustion, molecules in the combustion chamber ionize and a ionization current flows in the electrodes of the spark plug.

The classic structure of a spark plug is shown in FIG. 1.

Commonly, spark plugs have a metal casing 1 fitted over an insulator 2, usually molded or cast around a first metal electrode 3, axially extending from a high voltage terminal 4 at the outer end of the insulator to the inner tip 5 from which the first electrode 3 protrudes. The insulator 2 isolates the first electrode 3 from the threaded metal casing 1, permanently fitted over the isolator, adapted to mount the spark plug into a threaded hole of a cylinder head of the engine, and from a ground electrode 6, integral to or shorted to the metal casing 1 and having an end extension that is bent toward the tip of the first electrode 3, protruding out of the inner end of the insulator in order to form a discharge gap 7.

When the spark plug is mounted, the threaded metal casing 1 is driven tight into the threaded hole of a cylinder head of the engine and thus the ground electrode 6 is shorted to the electrical systems ground node. A high voltage generated by the ignition coil (supplied thought an Electronic Ignition Controller circuitry), is applied to the terminal of the first electrode 1. A spark then occurs in the discharge gap 7, the air/fuel mixture in the combustion chamber is ignited and a ionization current flows in the electrodes.

It is known in the art that the ionization current may be processed to provide early detection of plug fouling, for example, and more generally to monitor the combustion process. In particular, the sensed ionization current may be used in control loops to adjust ignition timing, valve timing, fueling, and/or airflow, for example, to better manage the combustion process.

FIG. 2 shows an exemplary graph of ionization current versus crank angle, in which three main phases of the combustion process are highlighted, namely the ignition phase, the flame-front phase and the post-flame phase. The ionization current is characterized by high frequency oscillations during the ignition phase (generating high frequency spectral components), then by a rapid increase and decrease during the flame-front phase and finally by a slow increase and decrease during the post-flame phase.

Ionic currents in spark plugs may be measured at the secondary of the ignition coil, substantially by connecting a sensing circuit between the low-voltage terminal of the secondary winding of the ignition coil and ground, as schematically shown in FIG. 3. Such sensing circuits are used to monitor the ionization current after the combustion has occurred.

It would be desirable a technique of sensing ionization currents crossing the electrodes of a spark plug during all phases of the combustion process.

SUMMARY

The applicants observed that the traditional sensing scheme is unsuitable for sensing ionization currents during the first two phases, namely the ignition phase and the flame-front phase. High frequency components of the ionization current cannot circulate in the secondary winding of the ignition coil, thus they flow through parasitic capacitances towards the supply node of the first electrode 1 and then to ground and/or are dissipated as heat losses in the magnetic core of the ignition coil. Therefore, the sensing scheme of FIG. 3 is useful to sense ionization currents only during the post-flame phase thereof, thus potentially useful information derivable from reading the ionization current during the ignition and the flame-front phases is not gathered.

Novel architectures of spark plugs for implementing a method of sensing ionization currents also during the ignition and flame-front phases in a very simple way have been devised by the applicants.

The novel spark plugs have a first electrode and a ground electrode insulated from one another by the dielectric material of the spark plug insulator in order to form a discharge gap at the inner tip of the insulator.

Differently from conventional spark plugs, a resistive element is electrically connected to the ground electrode such that when the spark plug is mounted in an internal combustion engine, the ground electrode results electrically connected to the engine body through a resistive element interposed there between in the flow path of the ionization current toward the ground node of the electrical system. Moreover, the ground electrode constitutes or is electrically connected to a second outer connection terminal, providing an accessible sensing terminal outside the combustion chamber. In this way, it is possible to monitor the ionization current even during the ignition and flame-front phases by sensing the voltage between the added sensing terminal end the ground electrode and the potential relative to the ground node of the engine body.

According to an embodiment, the resistive layer is substantially cylindrical and is placed around a tract or substantially the whole length of the outer surface of the ground electrode and contacts the metal casing of the spark plug, whilst an outer end portion of the ground electrode has an electrical connection termination constituting the sensing terminal.

The claims as filed are integral part of this description and are herein incorporated by reference.

DETAILED DESCRIPTION

Figure 4:
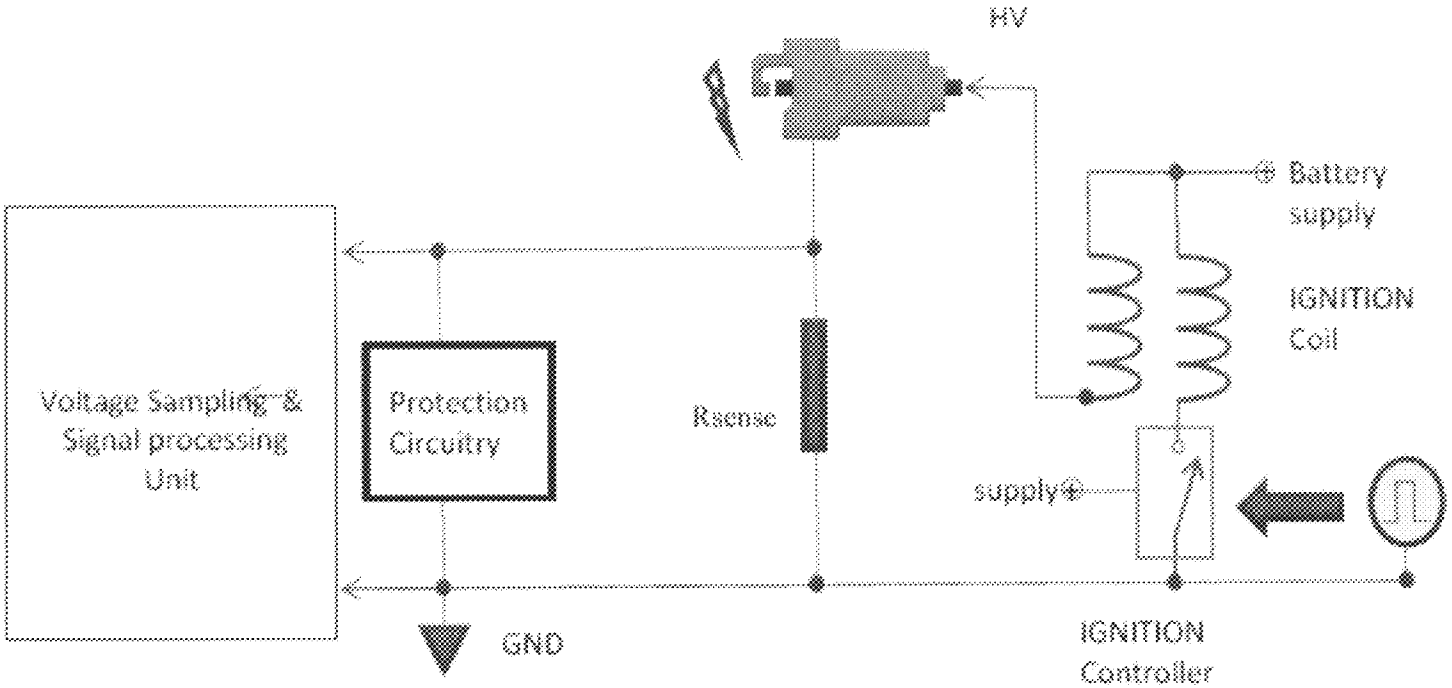
FIG. 4 shows an ignition control system and a circuit implementing the method of this disclosure for sensing ionization current.

A basic electric scheme implementing the novel method of sensing ionization currents crossing the electrodes of a spark plug is shown in FIG. 4.

Accordingly, a spark plug is equipped with a resistive element, Rsense, in the flow path of the ionization current toward the ground node of the electrical systems connected to the engine.

According to an embodiment, the sense resistor is electrically connected to the ground electrode such that, when the spark plug is mounted, the ground electrode electrically connects to the body of the engine through the interposed resistive element. Therefore, the ionization currents flows in the resistive element Rsense on which a voltage drop proportional to the current may be read by a sensing unit.

The novel sensing scheme is implemented using a modified spark plug architecture.

Figure 5:
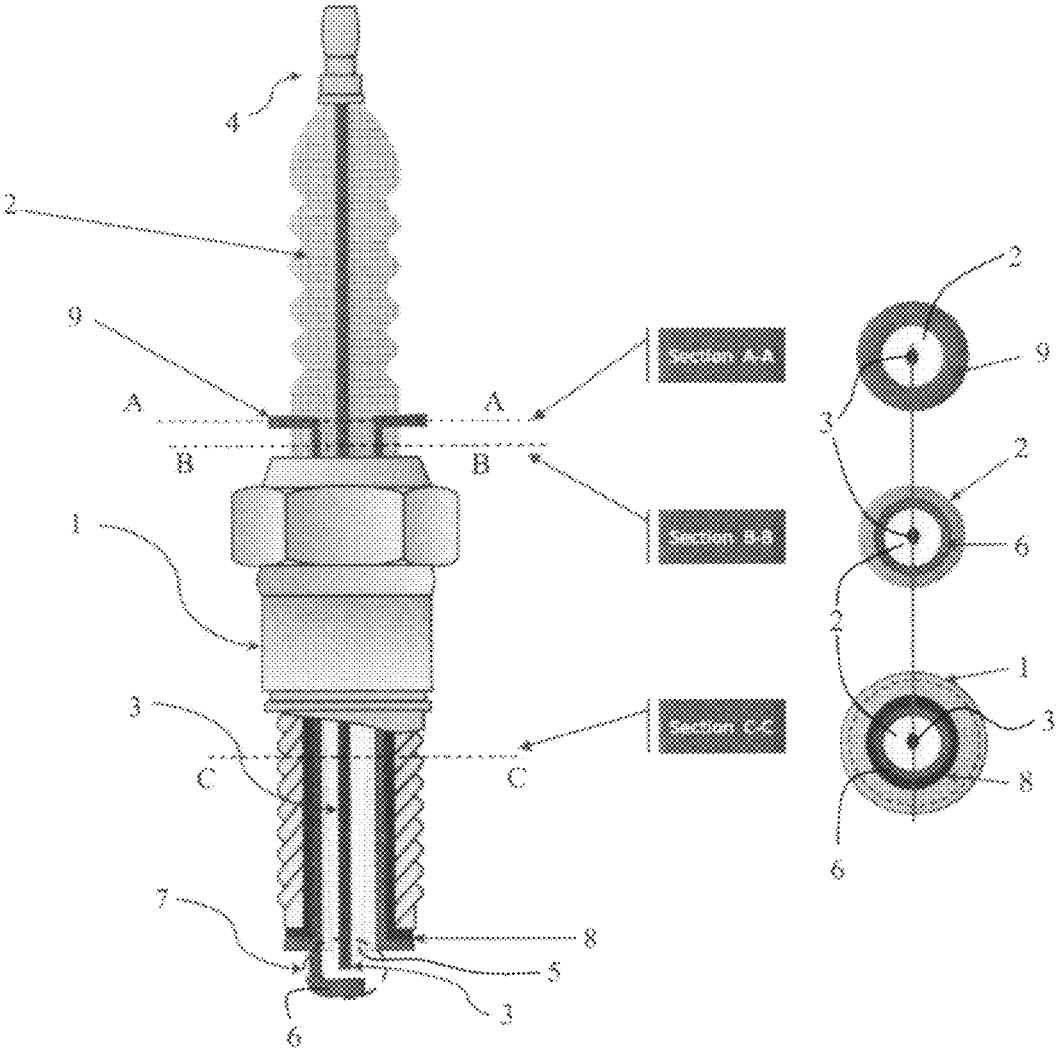
FIG. 5 shows an embodiment of a spark plug of this disclosure.

An embodiment of a novel spark plug is shown in FIG. 5. The ground electrode 6 is not directly in contact with the metal casing 1, but connects thereto through a resistive layer 8 applied over the outer surface cylindrical open-structured portion adapted to be embedded, alike the central electrode 3, in a molded or cast insulating material constituting the insulator 2. The resistive coating 8 may extend as far as the outer end of the metal casing 1 and the ground electrode 6 has an outer end flange, the rim of which emerges out of the cast insulator body 2, for constituting an accessible sensing terminal 9 outside the combustion chamber.

As in common spark plugs, the metal casing 1 is in contact with the metallic body of the engine, thus it is grounded upon mounting the spark plug in a cylinder head of the engine body. When a high voltage is applied on the terminal 4 of the first electrode 3, a spark occurs in the discharge gap 7, a ionization current flows through the resistive layer 8 and causes a voltage drop between the ground electrode 6 and the grounded metal casing 1. This voltage drop is substantially proportional to the ionization current and may be read on the accessible end terminal 9 of the ground electrode 6.

The ground electrode 6 is at a relatively low voltage and may be connected to an electronic sensing circuit without any problem of electrical isolation.

Though, in the novel spark plug the ground electrode 6 is not grounded when a ionization current flows, because of the non-null voltage drop on the resistive layer that constitutes the sense voltage, this does not affect the generation of the spark because the first electrode 3 is brought to a voltage greater than 10 kV and the voltage drop on the interposed resistive layer 8 is generally of few Volts.

Figure 1:
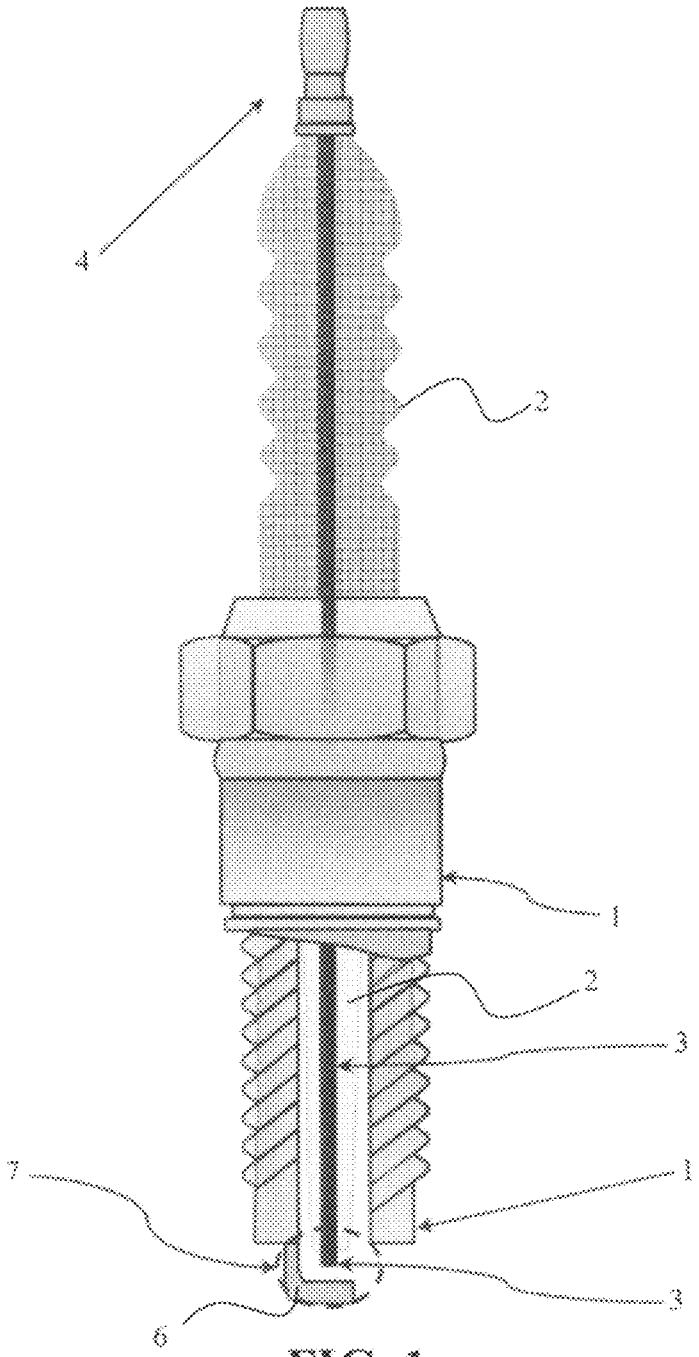
FIG. 1 shows a classic structure of a spark plug.
Figure 2:
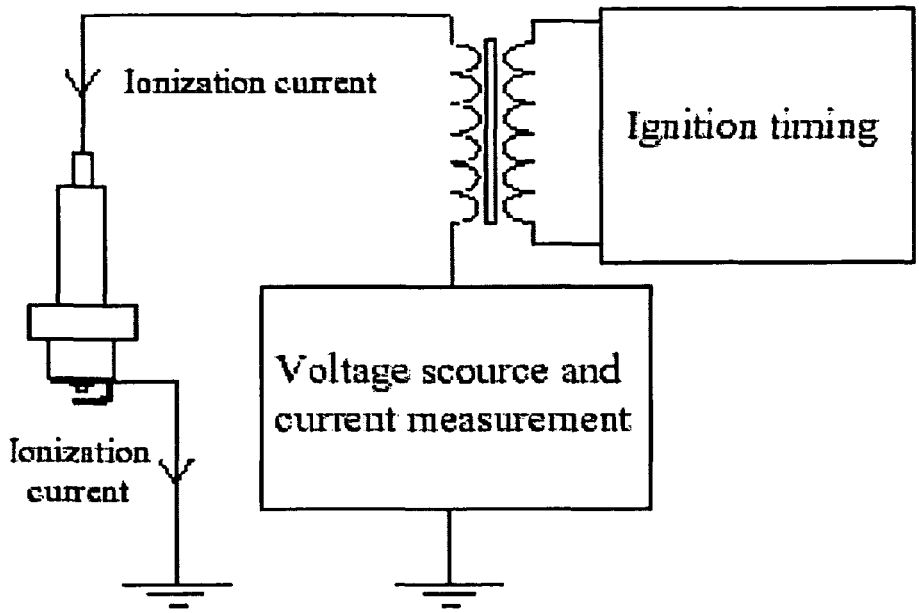
FIG. 2 is an exemplary graph showing the typical three phases of the ionization current during an engine cycle.
Figure 3:
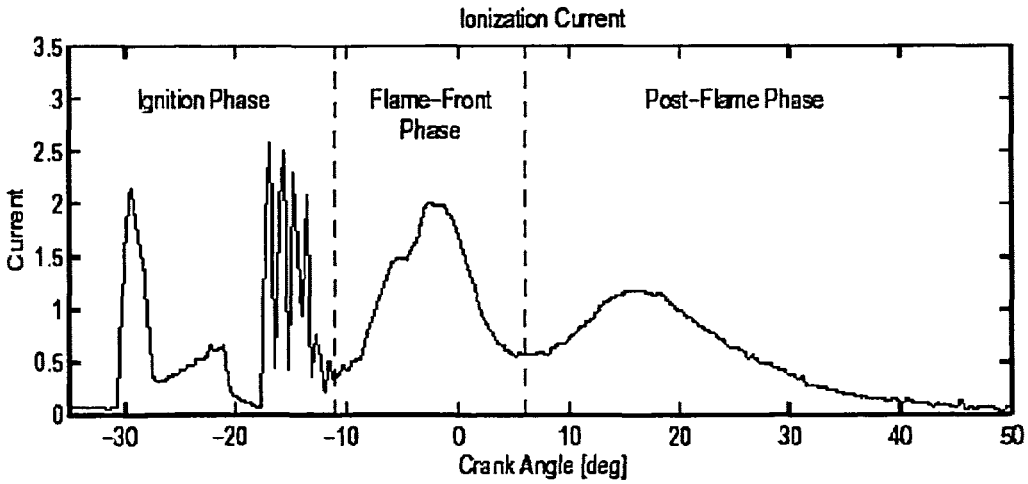
FIG. 3 shows a classic scheme for sensing the ionization current.

Differently from the known scheme of FIG. 3, wherein the circuitry does not allow the measurement of ionization current spectral components above few kHz because of the great value of stray inductances, stray capacitances and of the magnetic losses in the bulky iron core of the transformer, the novel spark plug allows to implement the scheme of FIG. 4 and thus to easily sense ionization currents even during the ignition phase and the flame-front phase because there is no low-pass filtering on the measured ionization current. Referring to FIG. 5, the sense voltage available on the sensing terminal 9 of the ground electrode 6 is proportional to the ionization current and may be used for accurately monitoring the evolution of the combustion of the air/fuel mixture in the combustion chamber.

In the embodiment of FIG. 5, a substantially cylindrical resistive layer 8 covers the ground electrode 6, substantially along the whole length thereof.

Figure 6:
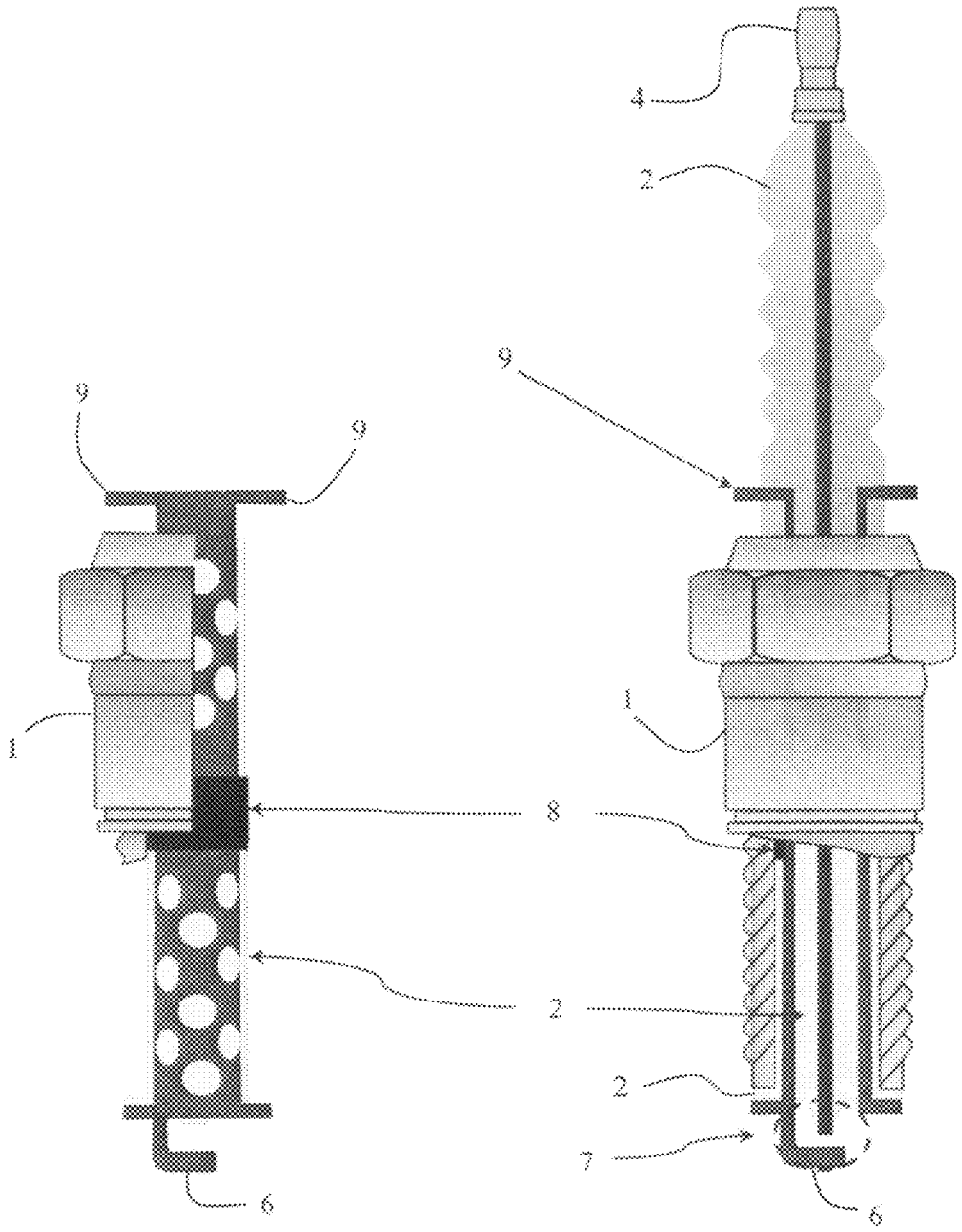
FIG. 6 shows another embodiment of a spark plug of this disclosure.

According to another embodiment, depicted in FIG. 6, the cylindrical resistive layer 8 does not extend for the full length of inner part of the ground electrode 6, but over a relatively short tract thereof, in correspondence of the coupling zone with the metal casing 1, to which it mechanically and electrically connects. In this case, the remaining portion of the outer cylindrical surface of the foraminous ground electrode 6 becomes embedded in the dielectric material of the molded or cast insulator 2.

According to yet another embodiment, not shown in the figures, the resistive layer 8 may be in the form of a strip longitudinally interposed between the opposing cylindrical surfaces of the ground electrode 6 and of the metal casing 1, the remaining portion of the outer surface of the ground electrode being mechanically coupled to the inner surface of the metal casing 1 through an intervening layer of dielectric material of the molded or cast insulator 2 casing.

According to yet another embodiment, not shown in the figures, the accessible sensing terminal 9 may be in form of a radially extending lead integral to the metallic ground electrode, protruding out of a molded or cast insulator 2, with a shape adapted to be easily connected with a spring clip to a sensing unit for reading the voltage thereon.

The resistive layer 8 may be made of conductive ceramic or cermet material, for example a conductive ceramic material of sub-stoichiometric conductive oxides or mixed oxides and/or containing metallic micro or nano-particles, or a cermet of ceramic particles in a metallic matrix, or of high temperature resistant (>200° C.) molded conductive resins, such as for example polyimide (TPI), polyetherimide (PEI), phenolic resins and mixtures thereof, of suitable resistivity. The electrical resistance of the resistive layer 8 of FIGS. 5 and 6 should match the electrical constraints of the circuit that reads the sense voltage.

Preferably but not necessarily, the resistive interlayer 8 has a resistance comprised between 10 and 500Ω. Preferably, the material with which resistive interlayer 8 is made should have a relatively small thermal coefficient in order to limit variations of resistance due to fluctuations of the working temperature to less than 10%.

Figure 7:
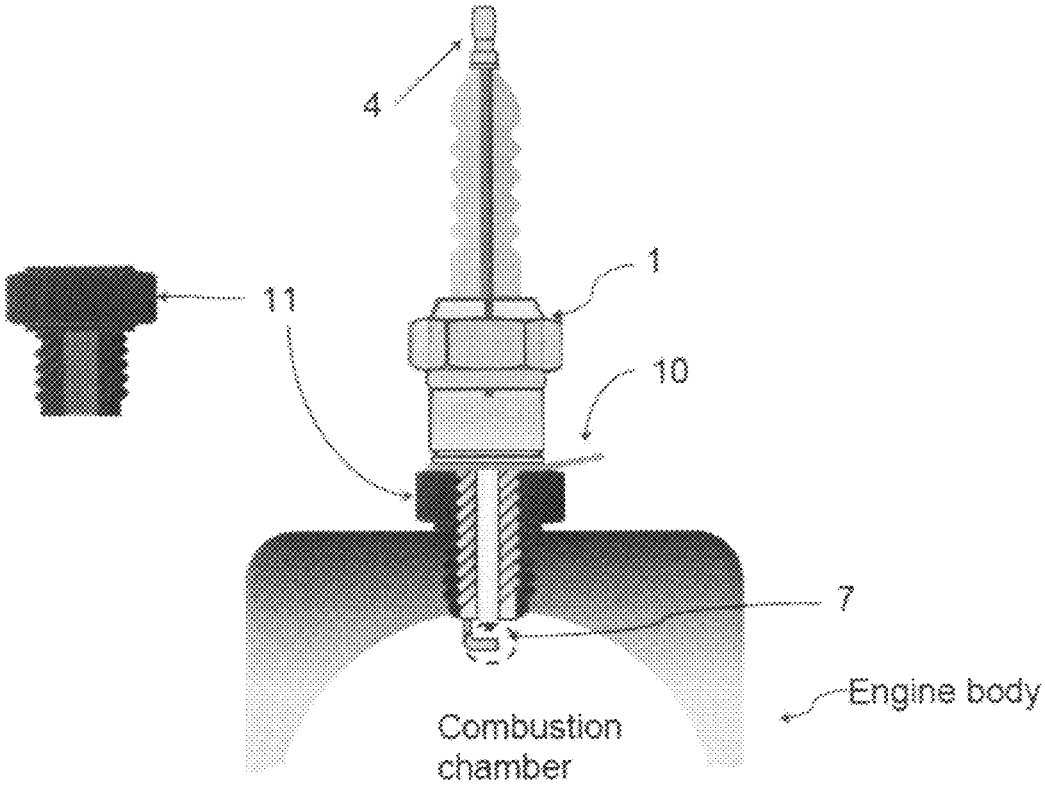
FIG. 7 shows yet another embodiment of a spark plug of this disclosure with an electrically resistive threaded ferrule in contact with the metal casing of the spark plug.

The resistive element Rsense of the scheme of FIG. 4, differently from the embodiments of FIGS. 5 and 6, may be realized even with other spark plug structures, for example according to another possible embodiment shown in FIG. 7, the resistive element may be in form of a resistive threaded ferrule-adapter 11 for mounting the spark plug into a threaded hole of a cylinder head of the engine and electrically connect the metal casing 1, which in this case may be commonly shorted to the ground electrode 6 (i.e. without interposition of a resistive layer therebetween, as in the previous embodiments), to the metallic body of the engine.

The sensing terminal may be constituted by a metal eyelet 10 over which tightens the metal casing 1 driving an outer threaded surface of the metallic ground electrode into the inner thread of the ferrule 11 made of suitably resistive material, as shown in FIG. 7.

Figure 8:
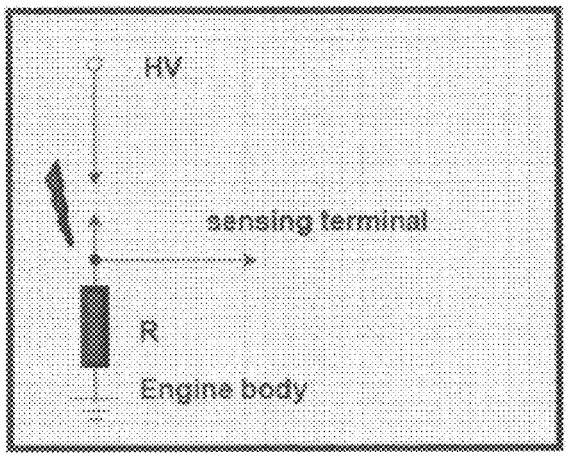
FIG. 8 shows the equivalent circuit of the structure of FIG. 7.

As shown in FIG. 8, being R the resistance opposed to the flow of current by the resistive ferrule 11, during combustion phases, a ionization current flows to the metal body of the engine, passing through the resistive ferrule 11, thus a sense voltage proportional to the ionization current is available on the metal casing 1 and on the metal eyelet 10 (if present).

Figure 9:
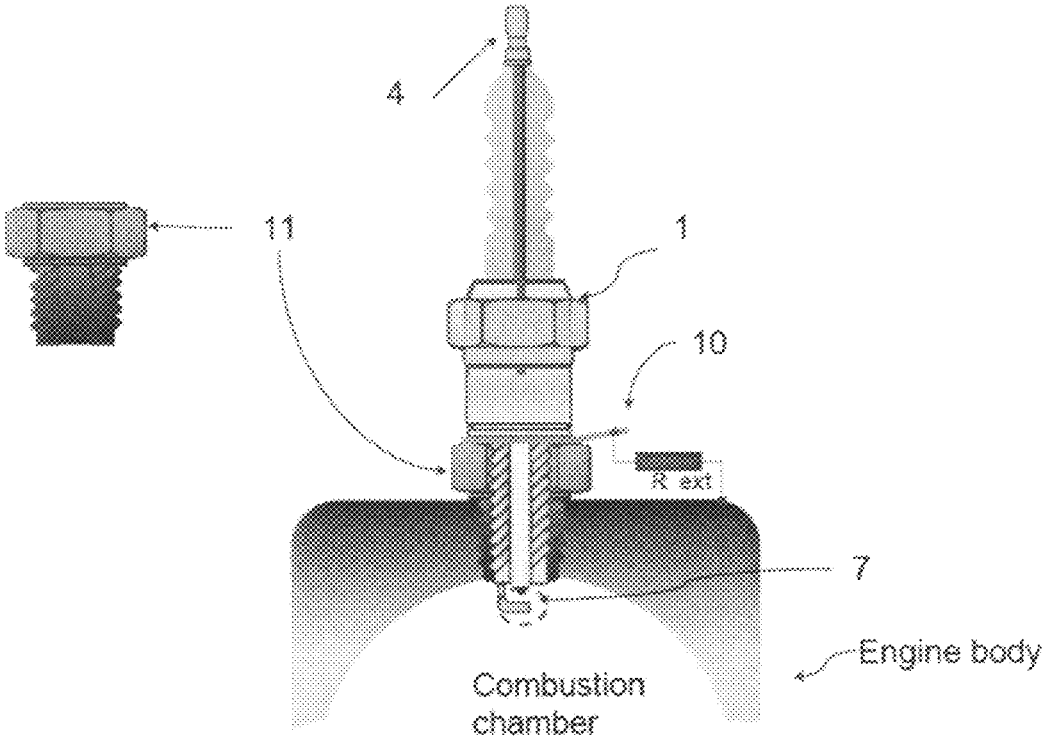
FIG. 9 shows yet another embodiment of a spark plug with an electrically insulating threaded ferrule and a sense resistor Rext connected between the metal casing of the spark plug and the engine body.
Figure 10:
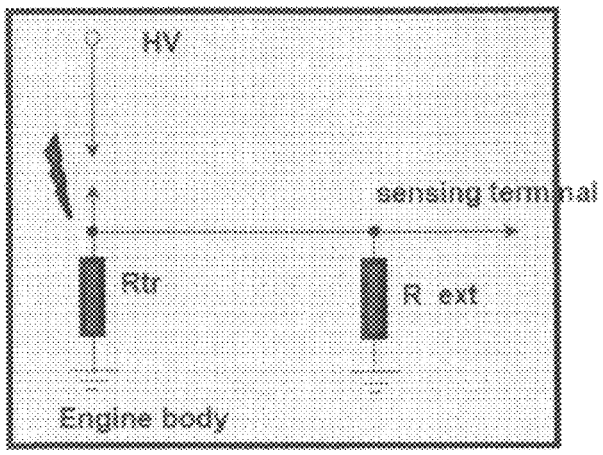
FIG. 10 shows the equivalent circuit of the structure of FIG. 9.

According to yet another embodiment, shown in FIG. 9, the metal casing 1 is practically isolated from the body of the engine by an insulating or highly resistive threaded ferrule 11, and has a metal eyelet 10, that is the casing, electrically connected to the grounded body of the engine by an external sense resistor Rext through which ionization currents may flow. The sense voltage is available on the metal casing 1 and on the metal eyelet 10. The equivalent circuit is shown in FIG. 10. In this case, the insulating ferrule has a great resistance Rtr, thus practically the whole ionization current flows in the external sense resistor Rext.

If an external sense resistor Rext is used as shown in FIG. 9, preferably it may have a resistance comprised between 10Ω to 500Ω and the material of the insulating ferrule 11 should have a resistivity such to make the insulating ferrule have an electrical resistance greater than at least 10 kΩ.

The sense voltage made available with the novel spark plug structures allows to monitor the ionization current during all phases of the combustion and thus potentially to acquire information about the evolution of the combustion process from the ignition of the air/fuel mixture. This may be done for example during a test phase using one of the novel spark plugs and a pressure sensor to sense the pressure in the combustion chamber. The sense voltage generated by the novel spark plug may be compared with the signal generated by the pressure sensor, with the objective of finding correlations between them. This would allow extrapolating useful information about the combustion process, when the engine is operating, directly from the sense voltage without using any expensive pressure sensor.

Having thus described at least one illustrative embodiment of the invention, various alterations, modifications, and improvements will readily occur to those skilled in the art. Such alterations, modifications, and improvements are intended to be within the spirit and scope of the invention. Accordingly, the foregoing description is by way of example only and is not intended as limiting. The invention is limited only as defined in the following claims and the equivalents thereto.

What is claimed is:

1. A spark plug comprising:

an insulator;

a first electrode embedded within and axially extending through said insulator from a high voltage outer end terminal to a center of an inner end of the insulator from which said first electrode protrudes;

a ground electrode isolated from said first electrode and comprising an extended inner termination facing toward said first electrode and extending from a tip of the insulator defining therebetween a spark gap;

a resistive element coupled to said ground electrode and configured so that upon mounting the spark plug in an internal combustion engine, said ground electrode electrically connects to an engine body through said resistive element; and a metal casing configured to be electrically coupled to the engine body upon mounting the spark plug in the internal combustion engine;

said ground electrode comprising a second outer termination configured to define an accessible sensing terminal;

said resistive element comprising a layer of resistive electrically conductive material between said ground electrode and said metal casing.

2. The spark plug of claim 1, wherein said ground electrode is cylindrical and concentric to said insulator; and wherein said second outer termination defines an extended portion of said ground electrode embedded in said insulator and emerging out of an outer end portion thereof.

3. The spark plug of claim 1, wherein said layer of resistive electrically conductive material is configured to cover a portion of a surface of said ground electrode corresponding to a coupling zone with said metal casing, a remaining portion of the surface being isolated from said metal casing by said insulator.

4. The spark plug of claim 1, wherein said layer of resistive electrically conductive material covers an outer cylindrical surface of said ground electrode having an open structure configured to become embedded in one of a molded or cast insulator.

5. A method of sensing ionization currents crossing electrodes of a spark plug, the method comprising:

electrically connecting a resistive element between a ground electrode of the spark plug and an engine body of an internal combustion engine so that, upon mounting in the internal combustion engine, the ground electrode electrically connects to the engine body through the resistive element and has a second outer termination defining an accessible sensing terminal when the spark plug is mounted, the resistive element comprising a layer of resistive electrically conductive material between the ground electrode and a metal casing of the spark plug to be electrically coupled to the engine body upon mounting the spark plug in the internal combustion engine;

mounting the spark plug in the internal combustion engine; and sensing a voltage between the accessible sensing terminal and the engine body.

6. A spark plug comprising:

an insulator;

a first electrode embedded within and axially extending through said insulator from a high voltage outer end terminal to a center of an inner end of the insulator from which said first electrode protrudes;

a ground electrode isolated from said first electrode and comprising an extended inner termination facing toward said first electrode and extending from a tip of said insulator defining therebetween a spark gap; and a resistive element coupled to said ground electrode and configured so that upon mounting the spark plug in an internal combustion engine, said ground electrode electrically connects to an engine body through said resistive element;

said ground electrode comprising a second outer termination configured to define an accessible sensing terminal and an outer threaded ground electrode surrounding an inner portion of said insulator;

said resistive element comprising a threaded resistive element coupled to said outer threaded ground electrode.

7. The spark plug of claim 6, further comprising a metal casing configured to be electrically coupled to the engine body upon mounting the spark plug in the internal combustion engine; and wherein said second outer termination comprises a metal eyelet between said metal casing and an end flange of said resistive element.

8. A spark plug comprising:

an insulator;

a first electrode embedded within and axially extending through said insulator from a high voltage outer end terminal to a center of an inner end of the insulator from which said first electrode protrudes;

a ground electrode isolated from the first electrode and comprising an extended inner termination facing toward the first electrode and extending from a tip of the insulator defining therebetween a spark gap; and a resistive element comprising at least one of molded conductive resin, a conductive ceramic coating, and a cermet coating, and having a resistance between 10 and 500 Ohms, coupled to said ground electrode and configured so that upon mounting the spark plug in an internal combustion engine, said ground electrode electrically connects to an engine body through said resistive element;

said ground electrode comprising a second outer termination configured to define an accessible sensing terminal.

9. A method of making a spark plug comprising:

embedding a first electrode within an insulator to axially extend therethrough from a high voltage outer end terminal to a center of an inner end of the insulator from which the first electrode protrudes;

forming a ground electrode to be isolated from the first electrode and comprising an extended inner termination facing toward the first electrode and extending from a tip of the insulator defining therebetween a spark gap; and coupling a resistive element to the ground electrode so that upon mounting the spark plug in an internal combustion engine, the ground electrode electrically connects to an engine body through the resistive element; and the ground electrode comprising a second outer termination defining an accessible sensing terminal;

the resistive element comprising a layer of resistive electrically conductive material between the ground electrode and a metal casing of the spark plug that is configured to be electrically coupled to the engine body upon mounting the spark plug in the internal combustion engine.

10. The method of claim 9, wherein the ground electrode is cylindrical and concentric to the insulator; and wherein the second outer termination defines an extended portion of the ground electrode embedded in the insulator and emerging out of an outer end portion thereof.

11. A method of making a spark plug comprising:

embedding a first electrode within and axially extending through an insulator from a high voltage outer end terminal to a center of an inner end of the insulator from which the first electrode protrudes;

forming a ground electrode to be isolated from the first electrode and comprising an extended inner termination facing toward the first electrode and extending from a tip of the insulator defining therebetween a spark gap; and coupling a resistive element to the ground electrode and so that upon mounting the spark plug in an internal combustion engine, the ground electrode electrically connects to an engine body through the resistive element;

the ground electrode being formed to include a second outer termination defining an accessible sensing terminal and an outer threaded ground electrode surrounding an inner portion of the insulator;

coupling the resistive element comprising coupling a threaded resistive element to the outer threaded ground electrode.

12. The method of claim 11, wherein the second outer termination comprises a metal eyelet between the metal casing and an end flange of the resistive element.

13. A method of making a spark plug comprising:

embedding a first electrode within and axially extending through an insulator from a high voltage outer end terminal to a center of an inner end of the insulator from which the first electrode protrudes;

forming a ground electrode to be isolated from the first electrode and comprising an extended inner termination facing toward the first electrode and extending from a tip of the insulator defining therebetween a spark gap; and coupling a resistive element comprising at least one of molded conductive resin, a conductive ceramic coating, and a cermet coating and having has a resistance between 10 and 500 Ohms, to the ground electrode and so that upon mounting the spark plug in an internal combustion engine, the ground electrode electrically connects to an engine body through the resistive element;

forming the ground electrode comprising forming a second outer termination to define an accessible sensing terminal.

* * * * *